US009016831B2

(12) United States Patent
Brenner et al.

(10) Patent No.: US 9,016,831 B2
(45) Date of Patent: Apr. 28, 2015

(54) METHOD AND CLEANING FLUID FOR CLEANING INKJET PRINT HEADS, USE OF A CLEANING FLUID OF THIS TYPE, METHOD FOR OPERATING INKJET PRINT HEADS

(71) Applicant: Océ Printing Systems GmbH, Poing (DE)

(72) Inventors: Walter Brenner, Niederding (DE); Admir Lela, Haar (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 13/899,926

(22) Filed: May 22, 2013

(65) Prior Publication Data

US 2013/0314471 A1 Nov. 28, 2013

(30) Foreign Application Priority Data

May 22, 2012 (DE) ..... 10 2012 208 512

(51) Int. Cl.
*B41J 2/165* (2006.01)

(52) U.S. Cl.
CPC ..... *B41J 2/16552* (2013.01)

(58) Field of Classification Search
CPC . B41J 2/16517; B41J 2/16552; B41J 2/16588
USPC ..... 347/22, 23, 25, 28
See application file for complete search history.

(56) References Cited

U.S. PATENT DOCUMENTS

| | | | | |
|---|---|---|---|---|
| 6,164,752 | A | 12/2000 | Schaefer et al. | |
| 6,324,353 | B1 | 11/2001 | Laussermair et al. | |
| 6,646,024 | B2 | 11/2003 | Beach et al. | |
| 6,665,424 | B1 | 12/2003 | Stringa | |
| 7,118,189 | B2 | 10/2006 | Kuester et al. | |
| 7,156,514 | B2 * | 1/2007 | Rosa | 347/100 |
| 7,918,530 | B2 * | 4/2011 | Kanfoush et al. | 347/22 |
| 2005/0243152 | A1 | 11/2005 | Rosa | |
| 2007/0188542 | A1 | 8/2007 | Kanfoush et al. | |

FOREIGN PATENT DOCUMENTS

JP 2011101956 A * 5/2011

OTHER PUBLICATIONS

Official Action corresponding to German Patent Application No. 10 2012 208 512.2 dated Mar. 8, 2013.

* cited by examiner

*Primary Examiner* — An Do
(74) *Attorney, Agent, or Firm* — Jenkins, Wilson, Taylor & Hunt, P.A.

(57) ABSTRACT

When cleaning inkjet print heads, a first cleaning fluid is provided which includes at least one cellulase or a catalytically active derivative thereof. A contaminated and/or blocked inkjet print head (12) is cleaned using this first cleaning fluid.

14 Claims, 1 Drawing Sheet

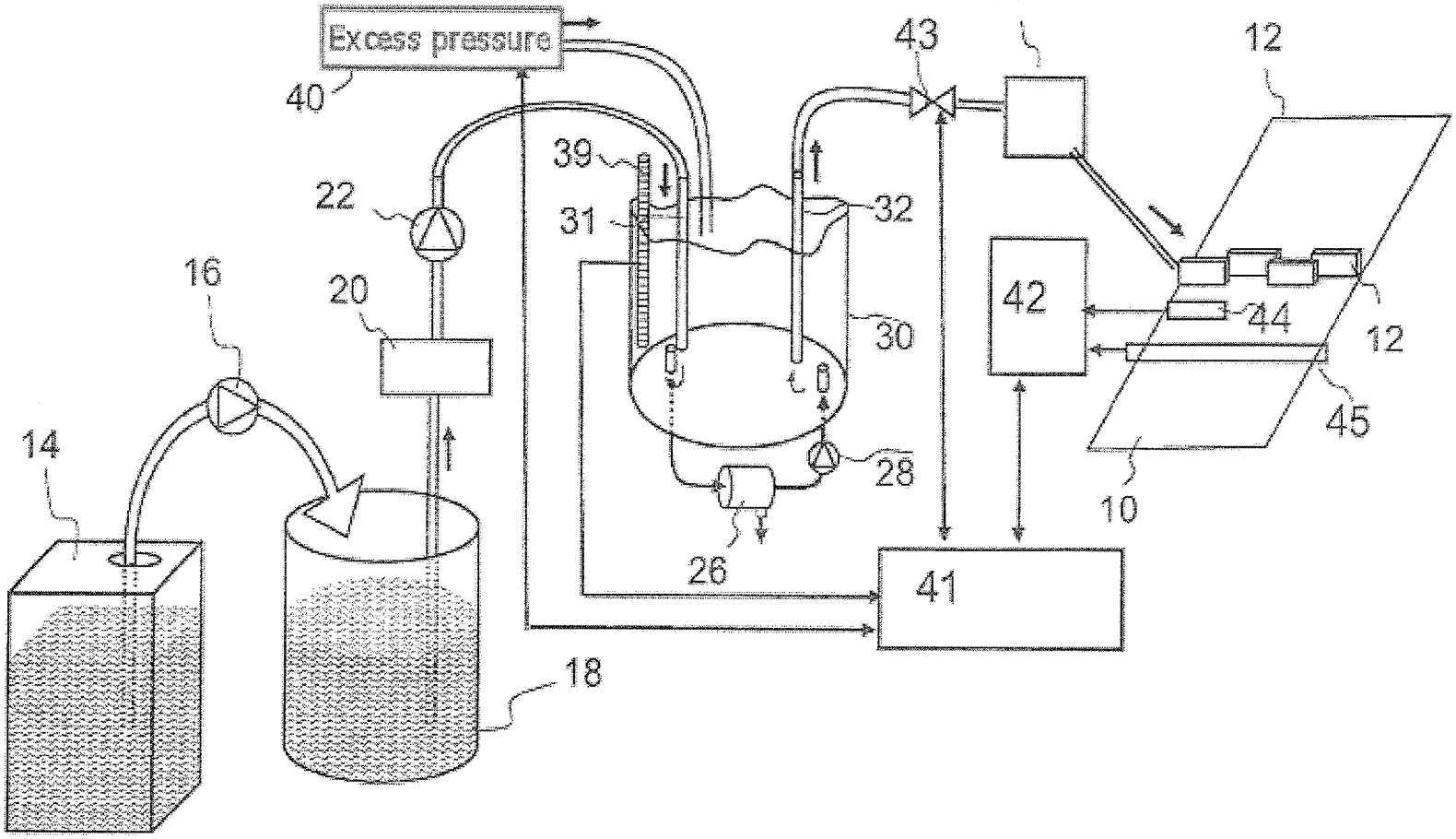
Excess pressure
12
12
45
44
10
24
42
41
43
32
30
28
26
39
31
18
40
22
20
16
14

METHOD AND CLEANING FLUID FOR CLEANING INKJET PRINT HEADS, USE OF A CLEANING FLUID OF THIS TYPE, METHOD FOR OPERATING INKJET PRINT HEADS

The present U.S. patent application claims priority to German Patent Application No. 10 2012 208 512.2, filed May 22, 2012, the disclosure of which is incorporated herein by reference in its entirety.

FIELD OF THE INVENTION

The present invention relates to a method for cleaning inkjet print heads. The present invention further relates to a cleaning fluid and to a use of a cleaning fluid of this type.

TECHNICAL BACKGROUND

Ink printers, often also referred to as inkjet printers, comprising one or more print heads are known in general and are used for example in transaction printing for producing personalised brochures. When the printing operation is interrupted, for example in order for the paper to be changed or in start-stop operation, there is the risk of ink residues contaminating the outlet region of the print heads and thus blocking individual outlet openings. In order to provide high print quality when using inkjet printers of this type, the print heads of said printers therefore have to be cleaned at regular intervals and in accordance with the printer status. It is important to clean the nozzles of the print heads in particular before starting up an inkjet printer which has not been used for some time.

The present invention relates in particular to a method for effectively cleaning inkjet printer heads, in particular inkjet printer heads of the type in which paper dust and ink residues have built up. In order for such inkjet print head nozzles which have been blocked by a mixture of ink and paper dust to be fully functional again, and for high quality to be ensured in inkjet printers, said nozzles have to be cleaned. There are various possibilities for the cleaning in this case:

- Rinsing the print heads and/or the nozzles provided therein inside the printer using the ink from the inkjet printing system. Thoroughly rinsing the print heads and, in this case, in particular the outlet openings of the print heads, is generally known as "purging".
- Rinsing the print heads inside or outside the printer using a standard cleaning fluid with and without increased rinsing pressure and/or increased rinsing time. The standard cleaning fluid is typically provided by the manufacturer of the inkjet printer ink.
- Manually cleaning using lint-free cloths and standard cleaning fluid.

U.S. Pat. No. 6,164,752 describes an ink printing device, in which, for thoroughly rinsing a print head, the print head is firstly positioned in a rinsing position, in which a rinsing cap covers the outlet nozzles. Ink is then sucked through the nozzles by applying a pulsed negative pressure via a suction cap.

U.S. Pat. No. 7,118,189 B2 describes a rinsing device for an ink printing device, in which ink is squeezed through the nozzles in a pulsed manner by means of an ink squeezing valve arranged in the ink supply line.

It is common to all the above-mentioned methods that the contaminants and blockages cannot be satisfactorily cleared from the nozzles of the print heads using said methods. It is also problematic that the blockage, which generally consists of a mixture of ink and paper dust, cannot be readily rinsed out of the nozzles, since the paper dust gives the blockage increased stability.

Conventional cleaning agents comprising surfactants or similar detergent substances are able to bind and thus clean away the ink. However, the combination of paper dust and ink cannot be cleared, or cannot be satisfactorily cleared, using cleaning agents of this type.

SUMMARY OF THE INVENTION

The problem addressed by the present invention is thus that of effectively cleaning blocked nozzles of inkjet printers, in particular blockages caused by a combination of paper dust and ink.

According to the invention, this problem is solved by a method having the features of claim 1 and/or by a cleaning fluid having the features of claim 6 and/or by a use having the features of claim 10.

Accordingly, the following is provided.

- A method for cleaning inkjet print heads, comprising the steps of: providing a first cleaning fluid, which comprises at least one cellulase or a catalytically active derivative thereof; providing a contaminated and/or blocked inkjet print head; cleaning the print head using the first cleaning fluid. The present invention further relates to a cleaning fluid and to a use of a cleaning fluid of this type.
- A cleaning fluid for cleaning contaminated and/or blocked inkjet print heads, at least containing: at least one surfactant, distilled water, isopropanol, at least one cellulase or a catalytically active derivative thereof, which is configured to dissolve a mixture of ink and paper dust which accumulates at an inkjet print head.
- A use of a cleaning fluid comprising at least one cellulase or a catalytically active derivative thereof for treating and/or cleaning inkjet print heads.
- A method for operating inkjet print heads, comprising the steps of: providing an inkjet print head; printing one or more recording medium with ink using the inkjet print head; providing a first cleaning fluid, which comprises at least one cellulase or a catalytically active derivative thereof; cleaning the inkjet print head using the first cleaning fluid.

By means of the method according to the invention, it is now possible to effectively clean inkjet print heads. Print heads can be extremely effectively regenerated, in particular even those print heads which could not be regenerated by means of the hitherto used methods (as mentioned at the outset).

Furthermore, it is also possible to increase the average service life of the print heads by means of the method according to the invention.

This method also saves cleaning fluid in comparison with methods without cellulase or a catalytically active derivative thereof. This is because the cellulase or the catalytically active derivative thereof can effectively treat and dissolve the paper deposits in the print heads such that, during subsequent further cleaning, remaining residues can also be easily removed. Using this method, it is also possible to easily clean print heads in which thorough rinsing is no longer possible, since the paper blockage is disintegrated by the action of the cellulase or the catalytically active derivative thereof by the cellulase breaking down the cellulose in the paper. As a result, the relatively small remaining constituents can be easily rinsed out.

Advantageous configurations and developments emerge from the additional dependent claims and from the description with reference to the figures of the drawing.

SUMMARY OF THE DRAWING

The present invention is described in greater detail in the following with reference to the single FIGURE of the drawings, in which:

FIG. 1 is a block diagram of an exemplary printing system, in which the method according to the invention can be used.

The appended schematic FIGURE is intended to provide greater understanding of the invention. It shows an embodiment and serves to explain principles and concepts of the invention in conjunction with the description. Other embodiments and many of the advantages mentioned emerge with reference to the drawings. The elements of the drawing are not necessarily shown to scale.

DESCRIPTION OF THE EMBODIMENTS

The present invention relates to a method for cleaning inkjet print heads, the print head being treated during cleaning using a cleaning fluid which comprises at least one cellulase or a catalytically active derivative thereof. In particular, inkjet print heads which are at least blocked by paper dust can therefore be cleaned thereby.

The origin of the cellulase or the catalytically active derivative thereof is, in this case, not subject to any particular restrictions and can originate from microorganisms such as bacteria, fungi, for example mould fungi, or other organisms which are known in general. Cellulases are enzymes which can break down cellulose, a main constituent of paper, into its base unit, β-glucose. The group of cellulases comprises three different types of enzymes, namely the endoglucanases, the exoglucanases and cellobiases or β-glucosidases, which carry out said breakdown of the cellulose in combination.

For the present invention, it is preferred that the cellulase which is contained in paper dust be broken into smaller pieces, preferably into shorter cellulose chains. In some methods, it is also preferred that the cellulose be broken down into cellobiose. In some other methods, it is preferred that the cellulose be broken down into β-glucose.

A catalytically active derivative of cellulase is a derivative that is derived from cellulase, for example a salt such as an alkali salt or an alkaline-earth salt of cellulase, which salt furthermore can, after forming the derivative by a reaction, catalyse the breakdown of cellulose and similar substances, for example in paper dust.

In the method according to the invention, it is preferred that the treatment with cellulose be carried out for a duration which is adequate for the cellulose to have been sufficiently broken down. What is known as the treatment time or cleaning time is based in this case for example on the type of cellulose used or the combination of cellulose or the derivatives thereof, the temperature, the pH value of the solution and, if necessary, other factors. The other factors may be, for example, the possibility for the cellulase to attack the paper dust, that is to say the attackable surface of the paper dust, which is an indication of the density of the paper blockage. Furthermore, ink particles or other fluids which have collected on the paper dust can also influence this time, since these firstly have to be dissolved by the cleaning fluid.

It is also preferred that the treatment be carried out at a temperature at which the cellulase or the catalytically active derivative thereof, or the combination of cellulases and or derivatives, has optimum catalytic activity. In certain embodiments, the treatment is carried out at a temperature in the range of from 5° C. to 60° C. Preferably, the treatment is carried out at a temperature in the range of from 15° C. to 50° C.

Furthermore, the treatment is preferably carried out at a pH value at which the cellulose, the catalytically active derivative thereof, or the combination of cellulases and derivatives, has optimum catalytic activity. In this case, it is preferred that the treatment be carried out at a pH value which is not detrimental to the nozzle of the print head and other constituents of the print head, and optionally of the printer, with which the cleaning agent comes into contact. Preferably, the treatment is therefore carried out at a pH value of from 5 to 9. Particularly preferably, the treatment is carried out at a pH value of from 6 to 8. The pH value can, if necessary, be suitably set by pH regulators and/or buffering agents.

In a preferred embodiment, a rinsing step using a second cleaning fluid is also associated with the treatment step using the cleaning fluid comprising at least one cellulase or a catalytically active derivative thereof. By means of this rinsing step, the softened paper dust is rinsed out of the nozzle. Particularly preferably, the second cleaning fluid does not contain cellulase or a catalytically active derivative thereof, since this second cleaning fluid does not have to carry out any further treatment of the paper dust. Rather, the second cleaning fluid is used merely to wash out the contaminants. For example, a standard cleaning solution for print heads, water, isopropanol or a mixture of water and isopropanol can be used as the second cleaning fluid. These substances can optionally be mixed with surfactant, depending on the efficacy of the preceding cleaning step.

Furthermore, the present invention relates to a cleaning fluid for inkjet print heads, comprising at least one cellulase or a catalytically active derivative thereof, at least one surfactant, distilled water and isopropanol. In this case, the distilled water is used for example to soften the paper dust and for the purpose of conveying the cellulase to the paper dust. Furthermore, it is also possible that the water has already dissolved constituents of the ink. Furthermore, the isopropanol causes the ink constituents to dissolve. In addition, the surfactant is used to improve the wetting of the water or the isopropanol on the contaminants, that is to say the paper dust and the ink residues. In particular, the cleaning fluid according to the invention does not comprise any ink and is also not mixed with ink before it is used for cleaning an inkjet print head or is used for operating the inkjet print head.

Any surfactants can be used for the cleaning fluid, as long as they ensure sufficient wetting of the water or the isopropanol on the contaminants. Non-ionic surfactants and optionally also cationic surfactants are preferred. Combinations of surfactants can also be used.

The cleaning agent preferably contains 55 to 95% by weight distilled water, 3 to 30% by weight isopropanol, 1.9 to 12% by weight surfactant and 0.1 to 3% by weight cellulase, based on 100% by weight cleaning fluid.

In addition to the above-mentioned constituents, additional additives can also be contained in the cleaning fluid, for example pH regulators, buffering agents, complexing agents, preservatives, emulsifiers, wetting agents, and additional solvents.

pH regulators ensure that an ideal pH value is set for the cellulase or the catalytically active derivative thereof or combinations thereof. Examples thereof are common acids and bases, such as acetic acid, citric acid, hydrochloric acid, ammonia, sodium hydrogen carbonate and sodium hydroxide.

Carbonate buffers or phosphate buffers, for example, can be used as buffering agents in order to maintain a suitable pH value for the cellulase or the catalytically active derivative thereof or combinations thereof.

Complexing agents can for example bind constituents of the ink which otherwise could cause precipitation of said constituents together with additional contaminants. Complexing agents of this type include, for example, EDTA or various crown ethers. Furthermore, emulsifiers and wetting agents can further increase the mode of action of the surfactant. In addition, said emulsifiers and wetting agents can also ensure that certain constituents of the contaminants remain in solution after being removed and do not adhere to the blockage again.

Propylene glycol ether, for example, is considered as a further solvent.

Furthermore, the cleaning agents can also contain preservatives so that they remain usable for a longer period of time.

In preferred embodiments, the cleaning fluid does not comprise any other enzymes in addition to cellulases or catalytically active derivatives thereof, since said enzymes would make the cleaning agent more expensive. In addition, in certain embodiments, no further improvement of the cleaning action of the print head can be achieved by using an additional enzyme, since in cases such as this the blockage is primarily made up of paper dust, which can be effectively broken down by the cellulase.

Furthermore, the present invention relates to the use of a cleaning fluid comprising at least one cellulase or a catalytically active derivative thereof for treating and/or cleaning inkjet print heads.

Using the method and the cleaning fluid of the present invention, any inkjet print heads which have blockages can be cleaned.

A print head in an exemplary inkjet printing system is shown in FIG. 1. An ink printer for printing a recording medium 10 comprises, according to FIG. 1, one or more print heads 12. A print head 12 contains one or more nozzles, through which droplets of ink are discharged towards the recording medium 10 as required by producing hydraulic pressure, for example via piezo elements. In high-performance printers, said print heads 12 are usually arranged in a stationary manner over the entire width of the recording medium 10, while the recording medium 10 moves through underneath the print heads 12.

The print head 12 can extend over the entire width of the recording medium 10. A plurality of print heads 12 can also be connected to form what is known as a pressure bar, which heads then each form a printed line transverse to the transport direction of the recording medium 10. According to FIG. 1, four print heads 12 form one pressure bar. If a plurality of pressure bars are provided, a colour (for example yellow, magenta, cyan and black; YMCK) can be printed by each pressure bar. In FIG. 1, all the pressure bars are attached to the same ink supply, and therefore printing is only carried out in a single colour. The printing resolution can therefore be higher, or one or two pressure bars can be provided for safety, through the nozzles of which ink is then discharged when the nozzle of a parallel pressure bar for the same printing dot is blocked.

The number of print heads 12 and the number of nozzles located therein per surface area (and optionally parallel print heads, which are slightly offset thereto) define the resolution at which a print head 12 or pressure bar of this type can print.

Fresh ink is taken from a replaceable ink storage container 14 and is conveyed into a buffering container 18 by means of a pump 16. In the buffering container 18, there should always be sufficient ink for it to be possible for the printing process to continue even when the empty ink storage container 14 is exchanged for a full container.

Via a filter 20, by means of which dirt particles are filtered out, the ink is pumped as required into an intermediate ink container 30 by means of an additional pump 22, the ink level of which intermediate container is largely kept at a predetermined level. The ink is later supplied to the individual print heads 12 for printing from this intermediate ink container 30 via a distribution tank 24.

A tube or hose system is used for conveying the ink, which system is made up of tubes or hoses. Known connections such as socket connections, screwed connections or shaped parts are used for interconnecting tubes or hoses. Fittings such as globe and gate valves are used as shut-off and control members. The ink is always then conveyed from one station to the next when this is required, that is to say when the ink level falls below the predetermined ink level in the buffering container 18 or the intermediate ink container 30.

Fresh ink is supplied to the intermediate ink container 30 via a tubular ink inlet 31 (feed tube or hose to the intermediate ink container 30). The ink is removed from the intermediate ink container 30 as required via an ink outlet 32, and is supplied to the print heads 12 via the distribution tank 24.

So that no cavitation (air bubbles) forms in, the print heads 12, ink is continuously removed from the intermediate ink container 30, is supplied to a degasification device 26 and is conveyed back into the intermediate ink container 30 via a degasification pump 28. The ink is therefore continuously conveyed in a degasification circuit. In this process, the ink flows through the degasification device 26, whereby the gases are dissolved out of the ink, that is to say the ink is degasified. The dissolved gas can be conducted away to the outside.

The degasification device 26 is intended not only to be active during printing, but also during breaks in printing and during cleaning of the print heads 12.

In addition, a level sensor 39 is arranged in the intermediate ink container 30, which sensor measures the ink level and, if the amount of ink is too low (if the ink level falls below a limit value), said sensor prompts fresh ink to be supplied to the intermediate ink container 30 via the buffering container 18. In order for there not to be a loss of print quality owing to cavitation, there always has to be sufficiently degassed ink in the intermediate ink container 30.

The ink in the intermediate ink container 30 is under excess pressure so that the ink can be transported to the print heads 12 with sufficient pressure. The excess pressure is generated via a pressure pump 40, which can generate an excess pressure of approximately 0 bar to 2 bar. If ink is pumped out of the intermediate ink container 30 to the print heads 12 for the purposes of cleaning the nozzles, of deaeration or of filling the print heads 12, then this takes place at an excess pressure of up to 2 bar. During the printing operation itself, atmospheric pressure (approximately 0 bar) prevails in the intermediate ink container 30.

When idle or during the printing operation, the ink in the print heads 12 is itself under a slight negative pressure. Leakage or unintended discharge of ink from the print head 12 or the nozzle duct is thus prevented, since ink droplets escaping in an undesired manner would impair the printed image. This slight negative pressure is produced in that the height/level of the ink level in the intermediate ink container 30 is below the ink level in the print head 12. The intermediate ink container 30 is therefore also referred to as a "backpressure tank".

For cleaning in particular the outlet openings of the nozzles in the print heads 12, the print heads 12 are either displaced into a cleaning position (not shown), or alternatively the print heads 12 can also remain approximately in their "write position", a cap (not shown) then being positioned over the nozzle openings which provides protection and acts as a collection basin for ink. In the subsequent rinsing process, ink is then rinsed out of the intermediate ink container 30 through the nozzle ducts.

This prevents the nozzle ducts from becoming blocked owing to an increase in the ink viscosity when idle (when the nozzles have not been used for a long period of time). In this case, any particles present or clumps of ink which are solidifying, which block or narrow the nozzle outlet openings, are rinsed away.

Ink can also be sucked out of the nozzle ducts or can be squeezed therein in order to remove possible contaminants of the ducts.

For cleaning, the print heads can be cleaned using the method according to the invention or using the cleaning fluid according to the invention. This can take place on one hand by a cleaning fluid, which comprises at least one cellulase or a catalytically active derivative thereof, being rinsed through the system and the print heads. On the other hand, the print heads can also be individually cleaned manually, for example after being removed from the system. In this case, the print heads are placed into the cleaning fluid, which comprises at least one cellulase or a catalytically active derivative thereof. Alternatively, the print heads can also be manually cleaned using a cotton bud, which is soaked with the cleaning fluid, which comprises at least one cellulase or a catalytically active derivative thereof.

The present invention thus also includes a method for operating inkjet print heads 12, comprising the steps, described in the following in greater detail, of:

- providing an inkjet print head 12;
- printing one or more recording media 10 with ink using the inkjet print head 12;
- providing a first cleaning fluid, which comprises at least one cellulase or a catalytically active derivative thereof;
- cleaning the inkjet print head 12 using the first cleaning fluid.

In certain embodiments, the inkjet print head 12 is cleaned using the cleaning fluid when said print head is contaminated or blocked. The contamination or blockage of the inkjet print head 12 can be identified in inkjet printing systems either by appearance, for example also in the case of impairment of the print quality on the recording medium 10, or automatically using suitably configured contamination- and/or soiling detection systems, such as correspondingly configured sensors. The cleaning can also take place in a plurality of inkjet print heads 12 in the inkjet printing system at the same time or at different times, preferably depending on the contamination or blockage of the individual inkjet print head 12.

The method according to the invention for operating inkjet print heads 12 thus includes the method according to the invention for cleaning inkjet print heads 12 and can thus also include all the preferred embodiments of this method for cleaning inkjet print heads 12.

It has been proven that the rinsing process and the cleaning process are particularly effective if the ink and/or the cleaning fluid which comprises at least one cellulase or a catalytically active derivative thereof is thoroughly rinsed through the nozzles comprising the outlet openings under excess pressure in shockwaves. The printing device contains a rinsing/cleaning device for this purpose. Said rinsing/cleaning device comprises a program-controlled control device 41, which is connected on one side to the pressure pump 40 and the level sensor 31 via control lines. The control device 41 is connected on the other side to a program-controlled evaluation device 42 and a control valve 43. In addition, a scanning device 44 can be arranged in the region of the print heads 12, which scanning device is used to detect soiling of the outlet openings of the nozzles 12 and to notify the evaluation device 42 of the degree of soiling. The scanning device is for example a commercially available optical scanning device, as known for example from U.S. Pat. No. 6,324,353 B1.

A further possibility for detecting soiling of the nozzles 12 and simultaneously possible flow disturbances and malfunctions consists in arranging an additional scanning device 45 in the region of the recording medium (paper 10). This additional scanning device 45 is configured to detect the print quality of the printed characters and to notify the evaluation device 42, which then calculates therefrom the degree of soiling of the nozzles 12.

This optical scanning device 45 can for example be designed according to U.S. Pat. No. 6,665,424 B1. The failure of one or more nozzles can also be detected by this scanning device.

During cleaning in the printer, it is also advantageous for cellulase or a catalytically active derivative thereof to no longer be present in the system during subsequent printing, since otherwise the recording medium would possibly disintegrate after printing. In this respect, in preferred embodiments at least one cellulase or a catalytically active derivative thereof, that is to say the first cleaning fluid, is not present in the inkjet print head 12 after cleaning and before printing.

This means that in embodiments of this type, the first cleaning fluid is removed from the print head after cleaning the print head 12 using the first cleaning fluid. Particularly preferably, in this case, the at least one cellulase or a catalytically active derivative thereof is also removed therefrom at the same time.

Alternatively, the at least one cellulase or a catalytically active derivative thereof can be removed before subsequent printing by rinsing using an additional cleaning fluid. In this case, this additional cleaning fluid can either be the second cleaning fluid or another, third, cleaning fluid.

It is thus not precluded that, during cleaning, the print heads 12 are firstly rinsed with the second cleaning fluid, and then are cleaned using the first cleaning fluid, and subsequently a third cleaning fluid is provided and the print head 12 is rinsed using the third cleaning fluid. In this case, the third cleaning fluid can be constituted as the first or the second cleaning fluid, it preferably comprising no cellulase or a catalytically active derivative thereof.

Furthermore, it is not precluded by the invention that yet further rinsing steps are carried out before or after cleaning using the first cleaning fluid.

EXAMPLE

Using a cleaning fluid containing cellulase, an inkjet print head blocked with paper dust and ink residues was cleaned. It was possible to clear the blockage and to clean the nozzles of the print head in this way.

Comparative Example

In an inkjet print head which was blocked in a similar way, it was not possible to clear the blockage by means of a conventional cleaning fluid, which did not contain any cellulase, in accordance with the method in example 1.

The present invention provides a method by means of which blocked nozzles of an inkjet print head, in particular those which are contaminated by paper dust and ink residues, are effectively cleaned. The print heads can be effectively regenerated, in particular even those which could not be regenerated by means of hitherto used methods. As a result, the service life of the print heads is improved. In addition, the operation of print heads of this type is more cost effective.

The above-mentioned configurations and developments can, where appropriate, be combined in any way. Further possible configurations, developments and implementations of the invention also include combinations of features of the invention, which features are either described above or in the following in relation to the embodiments, which combinations are not explicitly mentioned. In particular, a person skilled in the art will also add individual aspects as improvements or additions to the respective basic forms of the present invention.

LIST OF REFERENCE NUMERALS

10 recording medium, paper web
12 print head
14 ink storage container
16 pump
18 buffering container
20 filter
22 pump
24 distribution tank
26 degasification device
28 degasification pump
30 intermediate ink container
31 ink inlet line
32 ink outlet line
39 level sensor
40 pressure pump
41 control device
42 evaluation device
43 magnetic valve
44 scanning device
45 scanning device

What is claimed is:

1. A method for cleaning inkjet print heads, comprising the steps of:

providing a first cleaning fluid, which comprises at least one cellulase or a catalytically active derivative of the cellulase;

providing a contaminated or blocked inkjet print head; and cleaning the print head using the first cleaning fluid.

2. The method according to claim 1, comprising the additional steps of providing a second cleaning fluid and rinsing the print head using the second cleaning fluid.

3. The method according to claim 2, wherein the step of rinsing using the second cleaning fluid follows the step of cleaning using the first cleaning fluid.

4. The method according to claim 2, wherein the second cleaning fluid does not contain cellulase or a catalytically active derivative of the cellulase.

5. The method according to claim 1, wherein the step of cleaning using the first cleaning fluid is carried out at a temperature in the range of from 5° C. to 60° C.

6. The method according to claim 5, wherein the step of cleaning using the first cleaning fluid is carried out at a temperature in the range of from 40° C. to 50° C.

7. The method according to claim 1, wherein the first cleaning fluid is removed from the print head after cleaning the print head using the first cleaning fluid.

8. The method according to claim 7, wherein the at least one cellulase or a catalytically active derivative of the cellulase is removed therefrom at the same time as the first cleaning fluid is removed.

9. The method according to claim 1, comprising the following steps of providing a third cleaning fluid and rinsing the print head using the third cleaning fluid after cleaning the print head using the first cleaning fluid.

10. The method according to claim 1, wherein the first cleaning fluid at least contains:

at least one surfactant, distilled water, isopropanol, and at least one cellulase or a catalytically active derivative of the cellulase, which is configured to dissolve a mixture of ink and paper dust which accumulates at an inkjet print head.

11. The method according to claim 10, wherein the first cleaning fluid does not comprise any other enzymes in addition to cellulases or catalytically active derivatives of the cellulase.

12. The method according to claim 10, wherein the first cleaning contains, based on 100% by weight cleaning fluid:

55% by weight to 95% by weight distilled water;

3% by weight to 30% by weight isopropanol;

1.9% by weight to 12% by weight surfactant; and 0.1 to 3% by weight cellulase.

13. The method according to claim 10, wherein the first cleaning further comprises at least one additional additive, selected from pH regulators, buffering agents, complexing agents, preservatives, emulsifiers and wetting agents, and additional solvents.

14. The method according to claim 1, wherein further rinsing steps are carried out before or after cleaning using the first cleaning fluid.

* * * * *